United States Patent [19]

Koiwa et al.

[11] Patent Number: 4,987,870

[45] Date of Patent: Jan. 29, 1991

[54] IGNITION DEVICE FOR AN ENGINE

[75] Inventors: Mitsuru Koiwa; Toshiyuki Hino, both of Himeji, Japan

[73] Assignee: Mitsubishi Denki Kabushiki Kaisha, Tokyo, Japan

[21] Appl. No.: 417,419

[22] Filed: Oct. 5, 1989

[30] Foreign Application Priority Data

Oct. 11, 1988 [JP] Japan ..... 63-253840

[51] Int. Cl.[5] ..... F02P 3/04

[52] U.S. Cl. ..... 123/335; 123/198 D

[58] Field of Search ..... 123/198 D, 335

[56] References Cited

U.S. PATENT DOCUMENTS

| | | | |
|---|---|---|---|
| 3,838,672 | 10/1974 | Richards et al. | 123/644 |
| 3,900,013 | 8/1975 | Vignozzi et al. | 123/335 |
| 4,262,641 | 4/1981 | Mosely et al. | 123/335 |
| 4,625,689 | 12/1986 | Komurasaki | 123/335 |

*Primary Examiner*—Tony M. Argenbright

*Attorney, Agent, or Firm*—Sughrue, Mion, Zinn, Macpeak and Seas

[57] ABSTRACT

An ignition device for an engine comprises a signal generator to generate a signal in synchronism with the rotation of an engine, a waveform shaping circuit to shape the waveform of an output signal produced from the signal generator, an ignition device to determine ignition timing on the basis of the output of the waveform shaping circuit and to cause ignition in the engine, an ignition-cut controlling circuit to cut the igniting operation of the ignition device when the engine operates at more than a predetermined revolution number, a tachometer signal output circuit to detect the revolution number of the engine on the basis of the output of the waveform shaping circuit, and a tachometer driving means to receive the output of the tachometer signal output circuit and to drive a tachometer so as to indicate an engine speed.

1 Claim, 3 Drawing Sheets

IGNITION DEVICE FOR AN ENGINE

BACKGROUND OF THE INVENTION

1. Field of The Invention The present invention relates to an ignition device for an engine. More particularly, it relates to an engine ignition device having an overspeed proof function wherein an engine speed is detected.

2. Discussion of Background

FIG. 2 is a block diagram showing a construction of conventional engine ignition device having an overspeed proof or governor function. In FIG. 2, a reference numeral 1 designates a signal generator (SG), a numeral 2 designates a waveform shaping circuit which has an input terminal connected to the terminal of positive pole of the signal generator 1, and a numeral 3 designates a closing rate controlling circuit having an input terminal connected to the positive side of the signal generator 1 and another input terminal connected to a current detection circuit 9 which will be described hereinafter. A reference numeral 4 designates a bias circuit having a terminal connected to the closing rate controlling circuit 3 and another terminal connected to the negative side of the signal generator 1. A numeral 5 designates a capacitor which has an end connected to the closing rate controlling circuit 3 and another end connected to the ground. A numeral 6 designates a logical operation circuit which has an input terminal connected to the waveform shaping circuit 2 and a comparing circuit 10c which will be described later. A numeral 7 designates an overvoltage protective circuit having an input terminal connected to an ignition coil 12 and a battery (not shown). A numeral 8 designates an amplifying circuit having input terminals connected respectively to the logical operation circuit 6, the overvoltage protective circuit 7 and a current detection circuit 9. The current detection circuit 9 is connected to a resistor 14 the opposite end of which is grounded. A numeral 10 designates an ignition-cut controlling circuit which comprises a frequency-voltage transducing circuit 10a connected to a capacitor 10b the opposite pole of which is grounded and a comparing circuit 10c connected to an output terminal of the frequency-voltage transducing circuit 10a. An input terminal of the ignition-cut controlling circuit 10 is connected to the output terminal of the waveform shaping circuit 2. A numeral 11 designates a power transistor which has its base connected to the amplifying circuit 8, its collector connected to the ignition coil 12 and its emitter connected to the ground through a resistor 14 respectively. A numeral 13 designates an ignition plug connected to the secondary winding side of the ignition coil 12 which is, in turn, connected to a battery (not shown).

In the conventional engine ignition device having the construction described above, a bipolar, output is produced at the signal generator 1 to be supplied to the waveform shaping circuit 2 where the output signal is subjected to waveform shaping, whereby a pulse signal having a predetermined time width is obtainable. The pulse signal having the shaped waveform is supplied to the input terminals of the frequency-voltage circuit 10a and the logical operation circuit 6. The pulse signal is subjected to a frequency-voltage transformation in the circuit 10a. A voltage transformed therein is compared with a predetermined value in the comparing circuit 10c. When the value of voltage compared is larger than the predetermined value, the comparing circuit 10c generates an output signal which is supplied to the logical operation circuit 6. The logical operation circuit 6 is constituted in such a manner that when it receives an output from the comparing circuit 10c, it does not generate an output. Namely, when a voltage transformed from a frequency is lower than the predetermined value, an output is produced from the logical operation circuit 6. The output signal of the logical operation circuit 6 actuates the power transistor 11 through the amplifying circuit 8, whereby a voltage is produced at the primary winding of the ignition coil 12, hence a high voltage is induced at the secondary winding of the ignition coil 12 to thereby ignite the ignition plug 13. On the other hand, when there is no output from the logical operation circuit 6, the power transistor 11 is not actuated, hence no voltage is produced at the primary winding of the ignition coil 12, and an operation of ignition does not take place. Namely, when the revolution speed of the engine exceeds a predetermined revolution, the ignition-cut controlling circuit 10 operates to stop the ignition whereby the overspeed operation of the engine is avoidable.

In the conventional engine ignition device, a tachometer is connected to the primary winding side of the ignition coil 12 so that an engine speed is detected. When the engine becomes a state of overspeed, a voltage to the primary winding of the ignition coil 12 is cut and therefore, it is impossible to detect the engine speed after the cutting.

In the conventional engine ignition device wherein the engine speed is detected by detecting the primary voltage produced at the primary side of the ignition coil 12, the engine speed of the engine cannot be correctly detected.

SUMMARY OF THE INVENTION

It is an object of the present invention to provide an engine ignition device having overspeed proof function which is capable of detecting a correct engine speed.

The foregoing and other objects of the present invention have been attained by providing an ignition device for an engine which comprises a signal generator to generate a signal in synchronism with the rotation of an engine, a waveform shaping circuit to shape the waveform of an output signal produced from the signal generator, an ignition device to determine ignition timing on the basis of the output of the waveform shaping circuit and to cause ignition in the engine, an ignition-cut controlling circuit to cut the igniting operation of the ignition device when the engine operaters at more than a predetermined revolution number, a tachometer signal output circuit to detect the revolution number of the engine on the basis of the output of the waveform shaping circuit, and a tachometer driving means to receive the output of the tachometer signal output circuit and to drive a tachometer so as to indicate an engine speed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
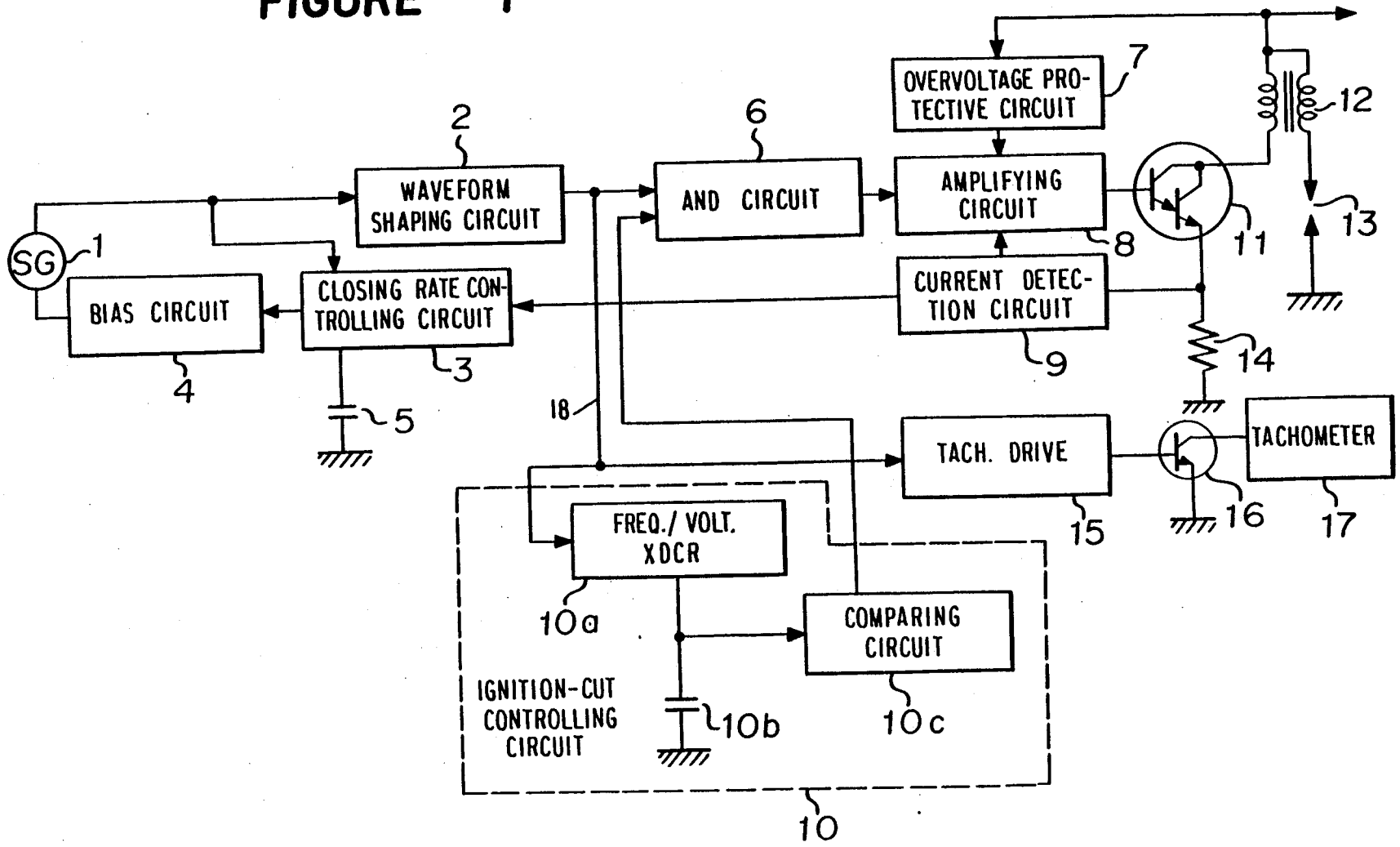
FIG. 1 is a block diagram of an embodiment of the engine ignition device according to the present invention.
Figure 2:
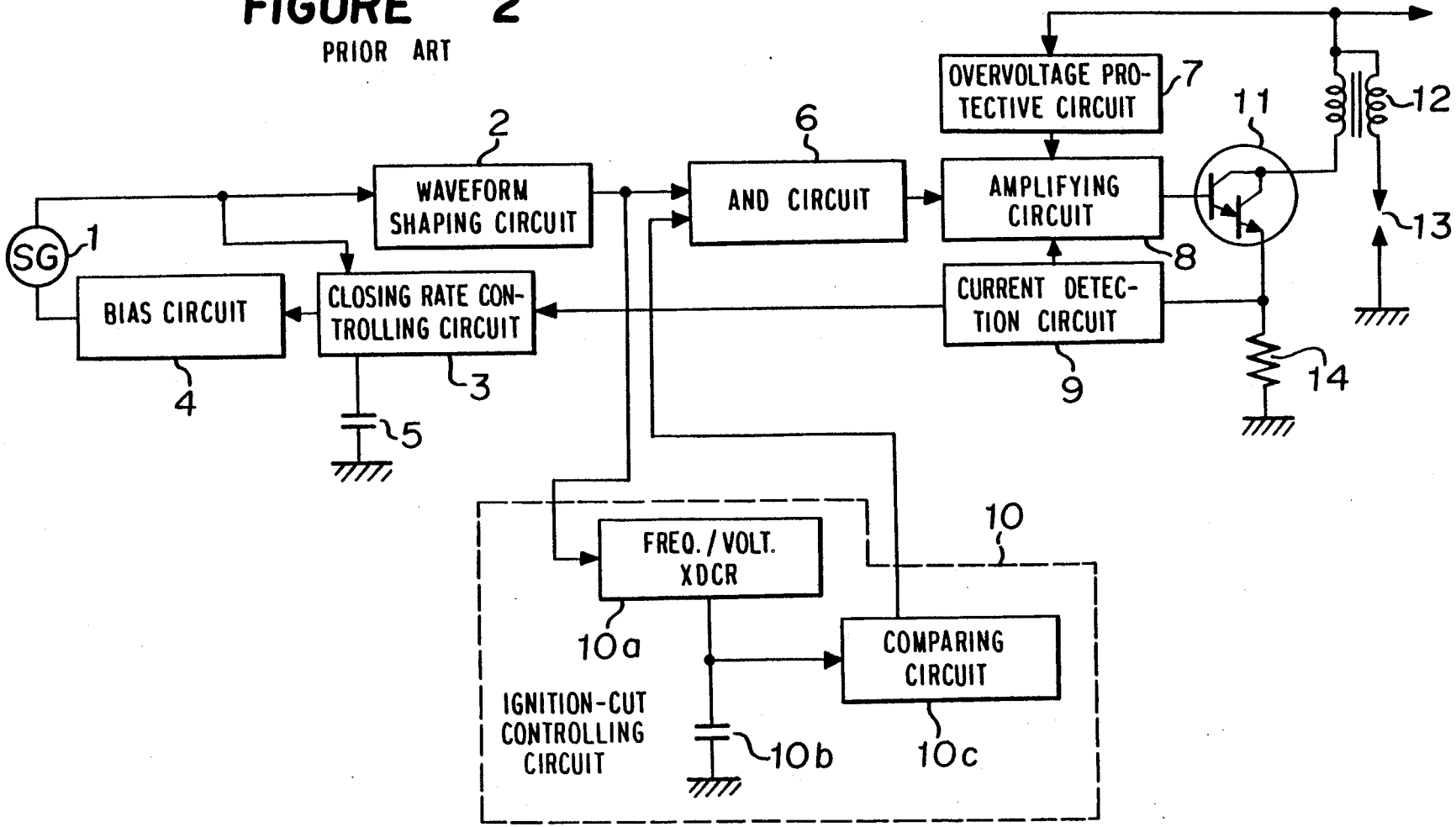
FIGURE 2 PRIOR ART
FIG. 2 is a block diagram showing a conventional engine ignition device.

Referring to the drawings, wherein the same reference numerals designate the same or corresponding parts, and more particularly to FIG. 1 thereof, there is shown a block diagram of a typical example of the engine ignition device of the present invention . In FIG. 1, a tachometer signal output circuit 15 is connected to the output side of the waveform shaping circuit 2. Specifically, the tachometer signal output circuit 15 is connected to the input side of the frequency-voltage transducing circuit 10*a* which is connected to the waveform shaping circuit through a line 18. A tachometer 17 is connected to the output side of the tachometer signal output circuit 15 through a transistor 16 which is driven by the output of the tachometer signal output circuit 15. The construction of the engine ignition device of the present invention is the same as that as shown in FIG. 2 except the above-mentioned construction.

An example of detecting the engine speed of the engine by using the tachometer 17 will be described. An output signal from the signal generator 1 is subjected to waveform shaping in the waveform shaping circuit 2. A pulse signal subjected to the waveform shaping is supplied to the tachometer signal output circuit 15 and the output of the circuit 15 drives the tachometer 17 through the transistor 16.

Figure 3:
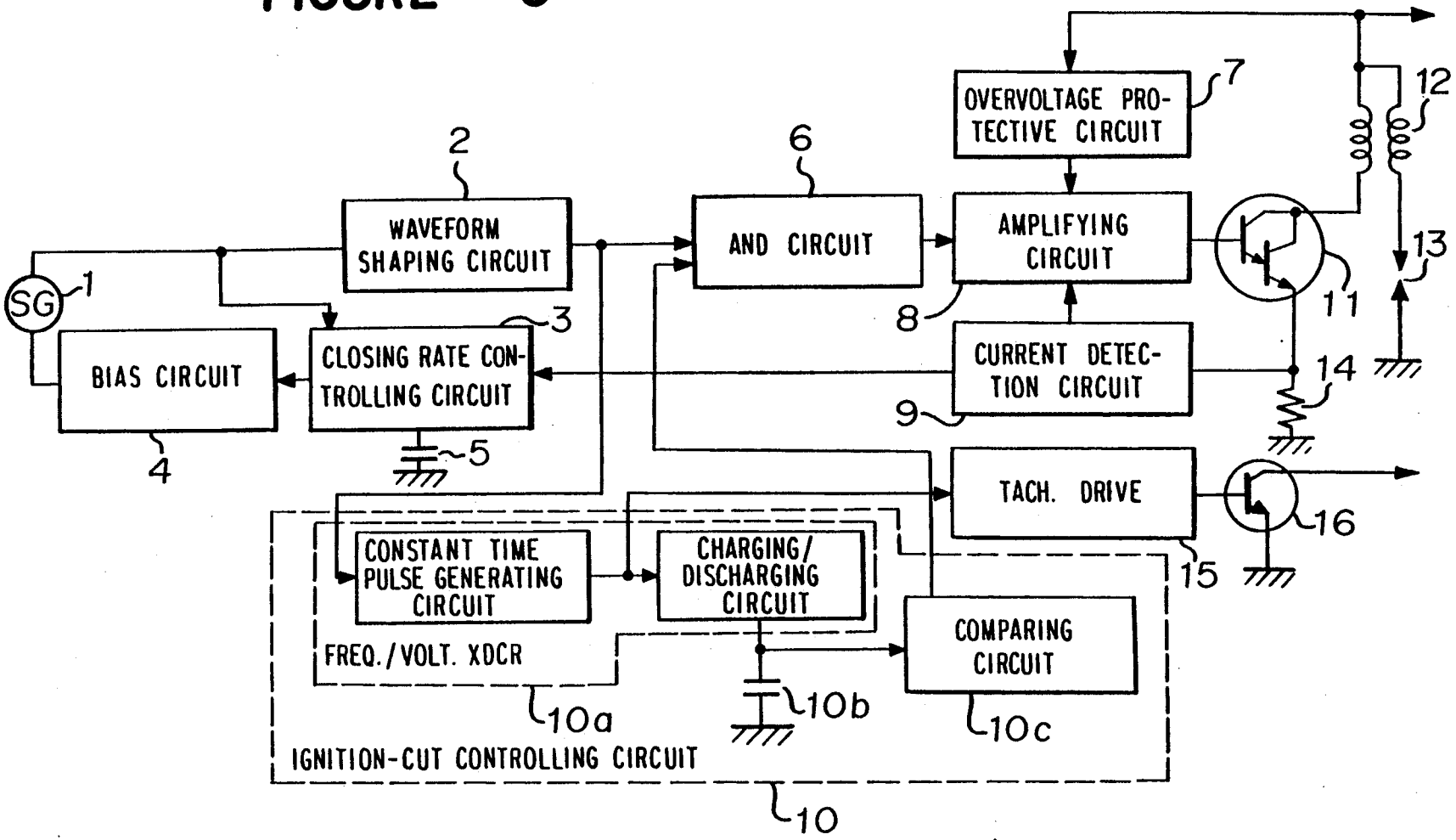
FIG. 3 is a block diagram showing another embodiment of the engine ignition device according to the present invention.

In the above-mentioned embodiment, the tachometer signal output circuit 15 is connected to the output side of the waveform shaping circuit 2. However, the same effect is obtainable by driving the tachometer 17 with a constant time pulse from the frequency-voltage transducing circuit 10*a*. FIG. 3 shows another embodiment of the present invention for effecting the above-mentioned function. In FIG. 3, the frequency-voltage transducing circuit 10*a* consists of a constant time pulse generating circuit and a charging/discharging circuit. The constant time pulse generating circuit is connected to the waveform shaping circuit so as to receive a signal outputted from the waveform shaping circuit 2. The junction between the constant time pulse generating circuit and the charging/discharging circuit is connected to the tachometer signal output circuit 15.

Thus, in accordance with the present invention having the construction described above, a correct engine speed can be always obtained.

Obviously, numerous modifications and variations of the present invention are possible in light of the above teachings. It is therefore to be understood that within the scope of the appended claims, the invention may be practiced otherwise than as specifically described herein.

What is claimed is:

1. An ignition device for an engine, which comprises:

a signal generator for generating a signal in synchronism with the rotation of an engine, a waveform shaping circuit for shaping the waveform of an output signal produced by said signal generator, an ignition device for determining ignition timing on the basis of the output of said waveform shaping circuit and for causing ignition in the engine, an ignition cutoff controlling circuit for cutting off the igniting operation of said ignition device when the engine operates at more than a predetermined number of revolutions, a tachometer signal output circuit for detecting the number of revolutions of the engine on the basis of the output of said waveform shaping circuit, and a tachometer driving means for receiving the output of said tachometer signal output circuit and for driving a tachometer to indicate the engine speed, wherein said ignition cutoff controlling circuit includes a frequency-voltage transducing circuit which is connected to said waveform shaping circuit, and said tachometer signal output circuit is driven by a constant time pulse generating circuit of said frequency-voltage transducing circuit.

* * * * *